US009646445B2

(12) United States Patent
Lu et al.

(10) Patent No.: US 9,646,445 B2
(45) Date of Patent: May 9, 2017

(54) INPUT AUTHENTICATION METHOD, INPUT AUTHENTICATION SYSTEM AND LOCK WITH INPUT AUTHENTICATION SYSTEM

(71) Applicant: TAIWAN FU HSING INDUSTRIAL CO., LTD., Kaohsiung (TW)

(72) Inventors: Shih-Min Lu, Kaohsiung (TW); Jiun-Nan Shiu, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 14/994,149

(22) Filed: Jan. 13, 2016

(65) Prior Publication Data

US 2017/0084104 A1 Mar. 23, 2017

(30) Foreign Application Priority Data

Sep. 18, 2015 (TW) ..... 104130882 A

(51) Int. Cl.

| | |
|---|---|
| ***G07C 9/00*** | (2006.01) |
| ***E05B 47/00*** | (2006.01) |
| ***E05B 17/10*** | (2006.01) |
| ***E05B 17/22*** | (2006.01) |

(52) U.S. Cl.

CPC ..... *G07C 9/00817* (2013.01); *E05B 17/10* (2013.01); *E05B 17/226* (2013.01); *E05B 47/0012* (2013.01)

(58) Field of Classification Search

CPC ..... G06F 21/36; G06F 21/32; G06F 21/316; G06F 3/017; G06F 21/31; G06F 3/0346; G06F 3/04883; G06F 21/78

USPC ..... 340/5.51

See application file for complete search history.

(56) References Cited

U.S. PATENT DOCUMENTS

| | | | | |
|---|---|---|---|---|
| 9,154,486 | B1 * | 10/2015 | Saylor | E05B 65/52 |
| 9,536,359 | B1 * | 1/2017 | Gokcebay | E05B 47/06 |

FOREIGN PATENT DOCUMENTS

| | | |
|---|---|---|
| TW | 451025 | 8/2001 |
| TW | M448543 U1 | 3/2013 |
| TW | M450603 U1 | 4/2013 |
| TW | M492940 U | 1/2015 |

* cited by examiner

*Primary Examiner* — Mark Blouin

(74) *Attorney, Agent, or Firm* — Winston Hsu; Scott Margo

(57) ABSTRACT

An input authentication method includes a processing unit generating a lead code according to a predetermined character string, wherein the predetermined character string includes a plurality of randomly arranged characters, the lead code is composed of N characters selected from the predetermined character string, and N is a positive integer; displaying the lead code on an input interface; the input interface receiving a first input; and when the first input corresponds to the N characters of the lead code, the processing unit performing a predetermined operation.

20 Claims, 7 Drawing Sheets

INPUT AUTHENTICATION METHOD, INPUT AUTHENTICATION SYSTEM AND LOCK WITH INPUT AUTHENTICATION SYSTEM

BACKGROUND OF THE INVENTION

1. Field of the Invention

The present invention relates to an input authentication method, an input authentication system and a lock with the input authentication system, and more particularly, to an input authentication method, an input authentication system and a lock with the input authentication system capable of increasing security.

2. Description of the Prior Art

Since a user only needs to enter a fixed password to unlock a conventional electronic lock, other people may easily know possible numbers constituting the password according to fingerprints left on buttons or positions of the buttons pressed by the user when entering the password. Thus other people can combine the above possible numbers in different ways to break the password in order to unlock the conventional electronic lock. Therefore, the conventional electronic lock has lower security.

SUMMARY OF THE INVENTION

The present invention provides an input authentication method, an input authentication system and a lock with the input authentication system capable of increasing security, in order to solve problems of the prior art.

The input authentication method of the present invention comprises a processing unit generating a lead code according to a predetermined character string, wherein the predetermined character string comprises a plurality of randomly arranged characters, the lead code is composed of N characters selected from the predetermined character string, and N is a positive integer; displaying the lead code on an input interface; the input interface receiving a first input; and when the first input corresponds to the N characters of the lead code, the processing unit performing a predetermined operation.

In an embodiment of the input authentication method of the present invention, when the first input corresponds to the N characters of the lead code, the processing unit performs the predetermined operation comprising: when the first input corresponds to the N characters of the lead code, the processing unit controls the input interface to receive a second input; and when the second input matches predetermined authentication information, the processing unit performs the predetermined operation.

In an embodiment of the input authentication method of the present invention, the predetermined character string comprises a plurality of substrings, each of the substrings comprises Arabic numbers 0 to 9, symbols and/or alphabets randomly arranged in a not-repeated manner, and arrangements of the plurality of substrings are different.

In an embodiment of the input authentication method of the present invention, a number of total characters in the predetermined character string is not a multiple of N.

In an embodiment of the input authentication method of the present invention, the predetermined character string comprises Arabic numbers 0 to 9, symbols and/or alphabets.

In an embodiment of the input authentication method of the present invention, the lead code is composed of N continuous characters in the predetermined character string.

In an embodiment of the input authentication method of the present invention, the N characters of the lead code are selected from characters mutually separated by an interval of M characters in the predetermined character string, and M is a positive integer.

In an embodiment of the input authentication method of the present invention, when one of the characters in the N characters is the last character of the predetermined character string, a Pth character of the predetermined character string is selected as a next character in the N characters, and P is a positive integer greater than 1.

The input authentication system of the present invention comprises a processing unit and an input interface. The processing unit is configured to generate a lead code according to a predetermined character string, wherein the predetermined character string comprises a plurality of randomly arranged characters, the lead code is composed of N characters selected from the predetermined character string, and N is a positive integer. The input interface is electrically connected to the processing unit, for displaying the lead code and receiving inputs. Wherein when the input interface receives a first input and the first input corresponds to the N characters of the lead code, the processing unit performs a predetermined operation.

In an embodiment of the input authentication system of the present invention, when the first input corresponds to the N characters of the lead code, the processing unit controls the input interface to receive a second input, and when the second input matches predetermined authentication information, the processing unit performs the predetermined operation.

In an embodiment of the input authentication system of the present invention, the predetermined character string comprises a plurality of substrings, each of the substrings comprises Arabic numbers 0 to 9, symbols and/or alphabets randomly arranged in a not-repeated manner, and arrangements of the plurality of substrings are different.

In an embodiment of the input authentication system of the present invention, a number of total characters in the predetermined character string is not a multiple of N.

In an embodiment of the input authentication system of the present invention, the predetermined character string comprises Arabic numbers 0 to 9, symbols and/or alphabets.

In an embodiment of the input authentication system of the present invention, the lead code is composed of N continuous characters in the predetermined character string.

In an embodiment of the input authentication system of the present invention, the N characters of the lead code are selected from characters mutually separated by an interval of M characters in the predetermined character string, and M is a positive integer.

In an embodiment of the input authentication system of the present invention, when one of the characters in the N characters is the last character of the predetermined character string, a Pth character of the predetermined character string is selected as a next character in the N characters, and P is a positive integer greater than 1.

In an embodiment of the input authentication system of the present invention, the predetermined operation is controlling an external electronic device.

The lock with input authentication system of the present invention comprises a processing unit, an input interface, a motor, a latch and a latch controlling unit. The processing unit is configured to generate a lead code according to a predetermined character string, wherein the predetermined character string comprises randomly arranged Arabic numbers 0 to 9, symbols and/or alphabets, the lead code is composed of N characters selected from the predetermined character string, and N is a positive integer. The input interface is electrically connected to the processing unit, for displaying the lead code and receiving inputs. The motor is electrically connected to the processing unit. The latch controlling unit is connected between the motor and the latch. Wherein when the input interface receives a first input and the first input corresponds to the N characters of the lead code, the processing unit controls the input interface to receive a second input; and when the second input matches a predetermined password, the processing unit controls the motor to drive the latch controlling unit to control the latch for unlocking.

In an embodiment of the lock with input authentication system of the present invention, the input interface is a touch screen comprising a plurality of virtual buttons.

In an embodiment of the lock with input authentication system of the present invention, the input interface comprises a plurality of physical buttons, and a plurality of light emitting components corresponding to the plurality of physical buttons.

In contrast to the prior art, the input authentication method, the input authentication system and the lock of the present invention allow a user to enter the lead code before entering the predetermined password, and the lead code displayed by the input authentication system varies each time. Therefore, not only fingerprints left by the user after entering the lead code are distributed evenly on each button, but also button positions of the lead code entered by the user are different each time, such that it is difficult for other people to break the correct predetermined password by combining numbers corresponding to the button positions pressed by the user. Therefore, the input authentication method of the present invention is capable of increasing security of the input authentication system and lock of the present invention.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
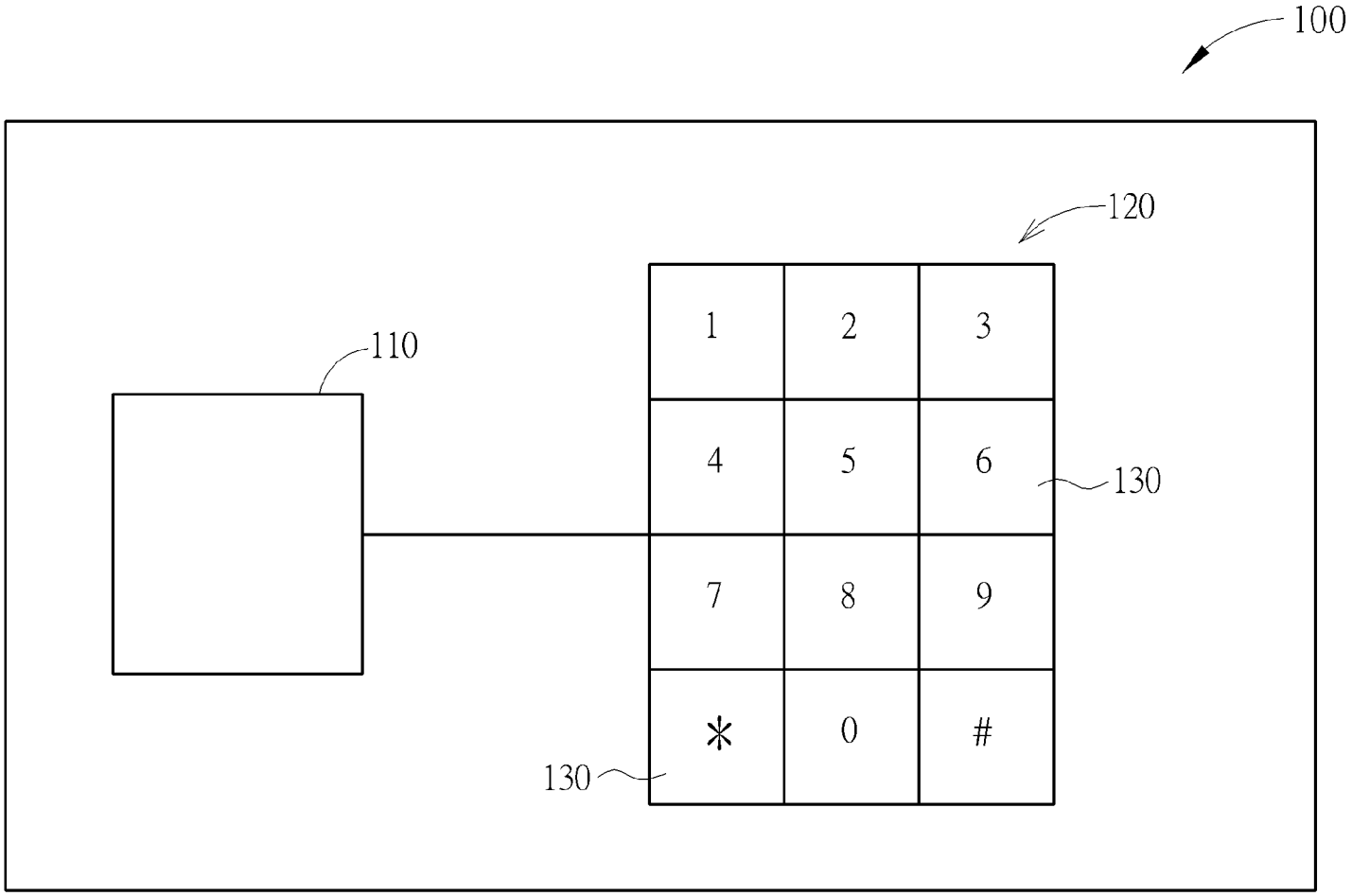
FIG. 1 is a diagram showing an input authentication system of the present invention.

Please refer to FIG. 1. FIG. 1 is a diagram showing an input authentication system of the present invention. As shown in FIG. 1, the input authentication system 100 of the present invention can comprise a processing unit 110 and an input interface 120. The processing unit 110 is configured to generate a lead code and control operations of the input interface 120. The input interface 120 is electrically connected to the processing unit 110 for displaying the lead code and receiving inputs from a user. Wherein, the input interface 120 can comprise a plurality of physical buttons 130, or the input interface 120 can be a touch screen comprising a plurality of virtual buttons 130, the present invention is not limited thereto. When the input interface 120 comprises the plurality of physical buttons 130, the input interface 120 can further comprise a display screen to show related information. In the present embodiment, the input interface 120 comprises buttons corresponding to Arabic numbers 0 to 9 and symbols, but in other embodiments of the present invention, the input interface 120 can also comprise buttons corresponding to English alphabets (or alphabets in other languages).

Figure 2:
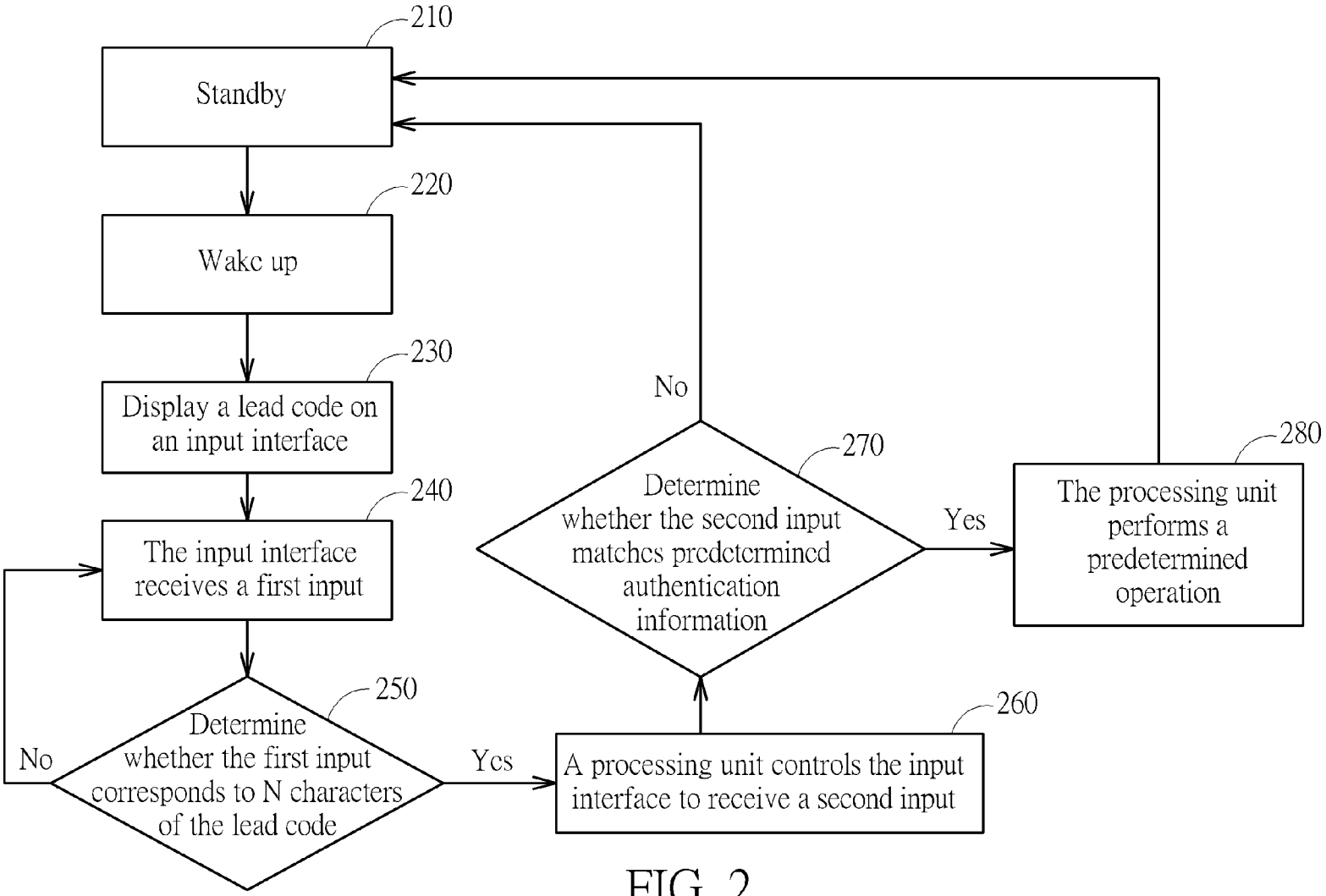
FIG. 2 is a flowchart showing operations of the input authentication system of the present invention.

Please refer to FIG. 2. FIG. 2 is a flowchart showing operations of the input authentication system of the present invention. As shown in FIG. 2, in step 210, the input authentication system 100 is in a standby mode. In step 220, the user can wake up the standby input authentication system 100 (for example, to press or touch the input interface 120 or the button 130 to wake up the input authentication system 100). In step 230, the awakened input authentication system 100 can display a lead code on the input interface 120. For example, when the input interface 120 comprises the plurality of physical buttons 130, the input interface 120 can display the lead code by turning on light emitting components (such as back light units) of the buttons 130 corresponding to the lead code with turning off light emitting components of the buttons 130 not corresponding to the lead code (or in an opposite way), or display the lead code on the display screen of the input interface 120; when the input interface 120 is a touch screen, the input interface 120 can indicate the virtual buttons corresponding to the lead code. The user can enter a first input according to the displayed lead code. In step 240, the input interface 120 can receive the first input from the user. Thereafter, in step 250, the processing unit 110 determines whether the first input corresponds to N characters of the lead code. For example, when the input interface 120 comprises the plurality of physical buttons 130, the processing unit 110 can determine whether the physical buttons pressed by the user correspond to the N characters of the lead code; or when the input interface 120 is a touch screen, the processing unit 110 can determine whether touched positions of the virtual buttons pressed by the user correspond to the N characters of the lead code. If the first input entered by the user does not correspond to the N characters of the lead code, the flowchart can go back to step 240 for allowing the input interface 120 to receive the first input from the user again. If the first input entered by the user comprises the N characters of the lead code, the flowchart can go to step 260 for allowing the processing unit 110 to control the input interface 120 to receive a second input from the user. In step 270, the processing unit 110 determines whether the second input matches predetermined authentication information. In the present embodiment, the predetermined authentication information can be a predetermined password. If the second input entered by the user does not match the predetermined authentication information, the flowchart can go back to step 210 for allowing the input authentication system 100 to be in the standby mode. If the second input entered by the user matches the predetermined authentication information, the flowchart can go to step 280 for allowing the processing unit 110 to perform a predetermined operation, such as unlocking or controlling an external electronic device. After performing the predetermined operation, the flowchart can go back to step 210 for allowing the input authentication system 100 to be in the standby mode.

The processing unit 110 of the input authentication system. 100 of the present invention can generate a plurality of lead codes. When the user wakes up the input authentication system 100 for the first time, the input interface 120 can display a first lead code for allowing the user to enter. When the user wakes up the input authentication system 100 the next time, the input interface 120 can display a second lead code for allowing the user to enter, and so on. Therefore, the lead code displayed on the input interface 120 is different each time when the user uses the input authentication system 100, such that it is difficult for other people to know possible characters (such as numbers, symbols and/or alphabets) constituting the predetermined password by observing button positions entered by the user, so as to increase security of the input authentication system 100. In addition, the input interface 120 can display all characters of the lead code at a same time; or the input interface 120 can sequentially display the characters of the lead code one by one. When the input interface 120 sequentially displays the characters of the lead code one by one, the user must enter a current character displayed on the input interface 120 in order to allow the input interface 120 to display a next character.

Figure 3:
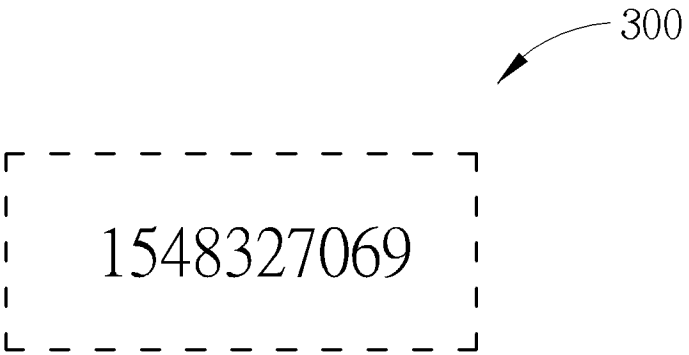
FIG. 3 is a diagram showing a first embodiment of a predetermined character string of the present invention.

In the input authentication method of the present invention, the processing unit 110 can store a predetermined character string in advance, and generate the lead code according to the predetermined character string. The predetermined character string can comprise randomly arranged Arabic numbers 0 to 9, symbols and/or alphabets. For simplification, the following embodiments only use Arabic numbers 0 to 9 and/or symbols constituting the predetermined character string. But in other embodiments of the present invention, if the input interface 120 comprises buttons corresponding to English alphabets (or alphabets in other languages), the predetermined character string can further comprise alphabets. Please refer to FIG. 3. FIG. 3 is a diagram showing a first embodiment of a predetermined character string of the present invention. As shown in FIG. 3, the predetermined character string 300 can be composed of Arabic numbers 0 to 9 randomly arranged in a not-repeated manner. The input authentication method of the present invention can generate the lead code according to the predetermined character string. The lead code is composed of N characters selected from the predetermined character string, and N is a positive integer. In an embodiment of the present invention, the lead code can be composed of N continuous characters in the predetermined character string. For example, the lead code is generated by selecting four continuous characters in the predetermined character string 300. As such, the first lead code is 1548, and the second lead code is 3270. When the processing unit 110 generates the third lead code from the predetermined character string 300, since only two characters left in the predetermined character string 300, selection of the rest characters in the third lead code can restart from the first character of the predetermined character string 300. As such, the third lead code is 6915, the fourth lead code is 4832, and so on. In the present embodiment, a number of total characters in the predetermined character string is not a multiple of N, in order to increase variations of the lead code, but the present invention is not limited thereto. In other embodiments of the present invention, a number of total characters in the predetermined character string can be a multiple of N.

Moreover, in another embodiment of the present invention, when one of the characters in the N characters of the lead code is the last character of the predetermined character string, selection of the rest characters in the N characters can restart from a Pth character of the predetermined character string, and P is a positive integer greater than 1. In other words, when the processing unit 110 generates the third lead code from the predetermined character string 300, selection of the rest characters of the third lead code can restart from a second character (or other character with a higher order) of the predetermined character string 300. For example, when the first lead code is 1548 and the second lead code is 3270, since the second character of the third lead code is the last character of the predetermined character string 300, a second character of the predetermined character string 300 is selected as the third character of the third lead code. As such, the third lead code is 6954, the fourth lead code is 8327, and so on. On the other hand, each time when the selection of the rest characters of the N characters of the lead code restarts from the Pth character of the predetermined character string, P can be changed along with restarting times in order to increase variations of the lead code.

In another embodiment of the present invention, the N characters of the lead code can also be selected from characters mutually separated by an interval of M characters in the predetermined character string, and M is a positive integer. For example, the four characters of the lead code are selected by the processing unit 110 from characters mutually separated by an interval of one character in the predetermined character string 300. As such, the first lead code is 1437; the second lead code is 6143, and so on. On the other hand, when selection of the lead code restarts from the beginning of the predetermined character string 300, a second character (or other character with a higher order) of the predetermined character string 300 can also be selected by the processing unit 110 as a next character of the lead code, in order to increase variations of the lead code. For example, the second lead code can be 6582, and so on.

Figure 4:
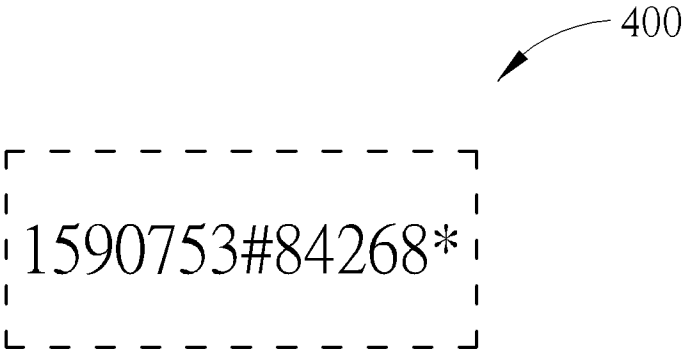
FIG. 4 is a diagram showing a second embodiment of the predetermined character string of the present invention.

In the input authentication method of the present invention, the predetermined character string can further comprise symbols. Please refer to FIG. 4. FIG. 4 is a diagram showing a second embodiment of the predetermined character string of the present invention. As shown in FIG. 4, the predetermined character string 400 can be composed of randomly arranged Arabic numbers 0 to 9 and symbols (such as * and #). Similarly, the aforementioned method for generating the lead code according to the predetermined character string 300 can also be applied to the predetermined character string 400 for generating the lead code. Since the predetermined character string 400 comprises randomly arranged Arabic numbers 0 to 9 and symbols, the lead code can have more variations. When the predetermined authentication information is a predetermined password and the predetermined password comprises symbols, the lead code generated according to the predetermined character string 400 can avoid other people to know the button positions of the predetermined password.

Figure 5:
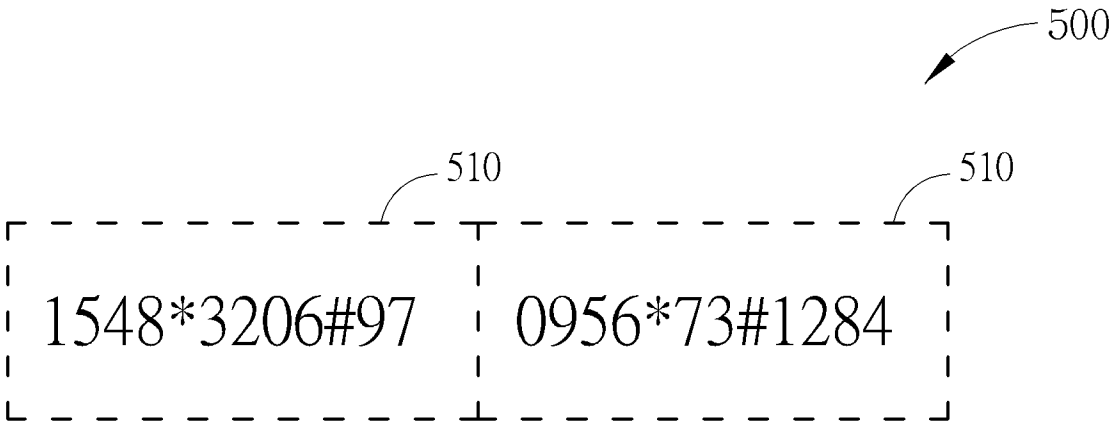
FIG. 5 is a diagram showing a third embodiment of the predetermined character string of the present invention.

On the other hand, the predetermined character string of the input authentication method of the present invention can also comprise a plurality of substrings, and arrangements of the plurality of substrings are different. For example, please refer to FIG. 5. FIG. 5 is a diagram showing a third embodiment of the predetermined character string of the present invention. As shown in FIG. 5, the predetermined character string 500 of the present invention can be composed of two substrings 510, each of the substrings 510 can comprise Arabic numbers 0 to 9 and symbols randomly arranged in a not-repeated manner, and arrangements of the two substrings are different. A total number of the substrings in the predetermined character string is not limited to the above embodiment. Similarly, the aforementioned method for generating the lead code according to the predetermined character string 300 can also be applied to the predetermined character string 500 for generating the lead code. Since the arrangements of the above substrings 510 are different, and appearing frequencies of Arabic numbers and symbols in the predetermined character string 500 are close or the same, appearing frequencies of Arabic numbers and symbols in the plurality of lead codes generated according to the predetermined character string 500 are close and the lead codes are not easy to repeat.

According to the above arrangement, when the predetermined authentication information is the predetermined password, since the lead code entered on the input interface 120 by the user is different each time, it is difficult for other people to know the possible numbers constituting the predetermined password by observing button positions pressed by the user. Therefore, security of the input authentication system 100 is increased. Moreover, the plurality of lead codes generated from the predetermined character string in the input authentication method of the present invention can allow appearing frequencies of Arabic numbers 0 to 9 (and/or symbols) to be close when the user enters the lead codes, such that fingerprints left on the input interface 120 are distributed evenly on each button, so as to further increase security of the input authentication system 100 of the present invention.

In addition, if the generated lead code comprises repeated characters, the lead code can be skipped for using a next lead code without repeated characters, or the repeated character in the lead code is replaced by a following character in the predetermined character string to form the lead code without repeated characters. The arrangement of the above predetermined character string, length of the character string, a number of total characters constituting the lead code, and method for generating the lead code are illustrated for examples, the present invention is not limited thereto.

In the above embodiment, the predetermined character string only comprises Arabic numbers 0 to 9 and/or symbols, but when the predetermined character string comprises alphabets, character arrangement of the predetermined character string and method for generating the lead code are similar to the above embodiments.

Figure 6:
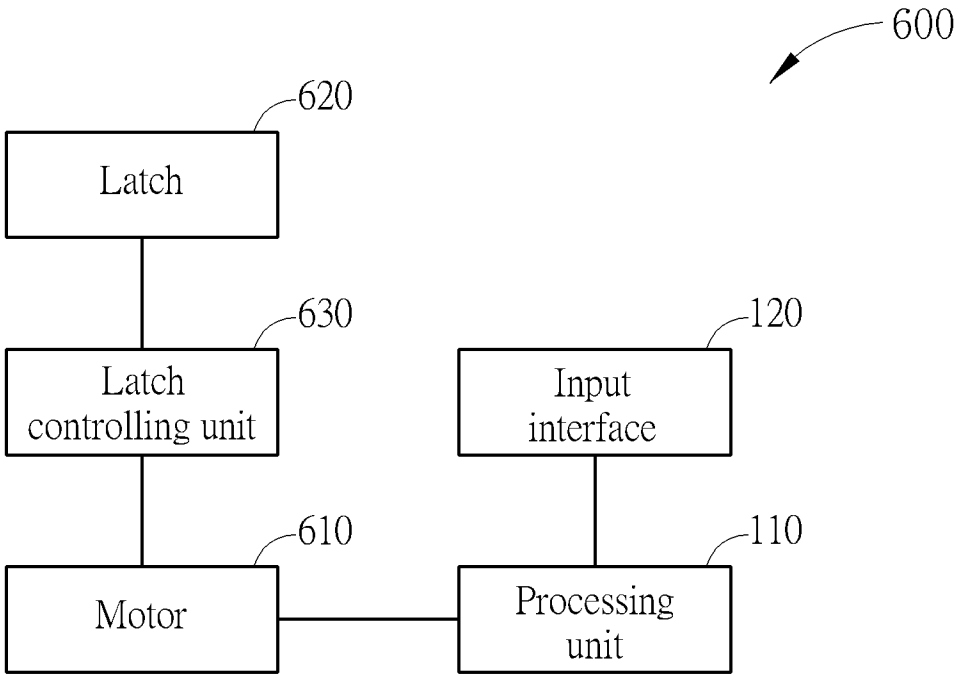
FIG. 6 is a functional block diagram of a lock with input authentication system of the present invention.

Please refer to FIG. 6. FIG. 6 is a functional block diagram of a lock with input authentication system of the present invention. As shown in FIG. 6, the lock 600 with input authentication system of the present invention comprises the processing unit 110, the input interface 120, a motor 610, a latch 620 and a latch controlling unit 630. The processing unit 110 and the input interface 120 in FIG. 6 are similar to the processing unit 110 and the input interface 120 in FIG. 1, therefore, no further illustration for the processing unit 110 and the input interface 120 is provided. The motor 610 is electrically connected to the processing unit 110. The latch controlling unit 630 is connected between the motor 610 and the latch 620, and the latch controlling unit 630 can comprise a clutch mechanism or a linkage mechanism to control the latch 620 to lock or unlock. When the user operates the lock 600 to unlock, the user must enter the first input according to the lead code display on the input interface 120 firstly. If the first input entered on the input interface 120 by the user corresponds to the lead code, the processing unit 110 controls the input interface 120 to receive a second input. If the second input entered on the input interface 120 by the user matches a predetermined password, the processing unit 110 controls the motor 610 to rotate, for driving the latch controlling unit 630 to control the latch 620 to unlock. Similarly, since the lead code displayed by the input interface 120 is different each time, it is difficult for other people to know the possible characters (such as numbers, symbols and/or alphabets) constituting the predetermined password by observing button positions pressed by the user. Therefore, security of the lock 600 is increased.

In addition, the input authentication system 100 of the present invention can also be used to control an external electronic device. For example, when the user enters a correct lead code and predetermined authentication information on the input interface 120, the processing unit 110 can wired or wirelessly control the external electronic device to perform a related operation.

In addition to the predetermined password, the predetermined authentication information of the present invention can also be a predetermined figure, fingerprints of the user, other biological features of the user, or any verifiable information. Accordingly, the input interface 120 can comprise a corresponding input mechanism for the above predetermined authentication information.

Moreover, when the first input received by the input interface 120 corresponds to the lead code, the input authentication system 100 of the present invention can also directly perform a predetermined operation without entering the second input. Since the lead code entered each time is not easily repeated, the input authentication system 100 can prevent wrong operation due to accidental touch of the user.

Figure 7:
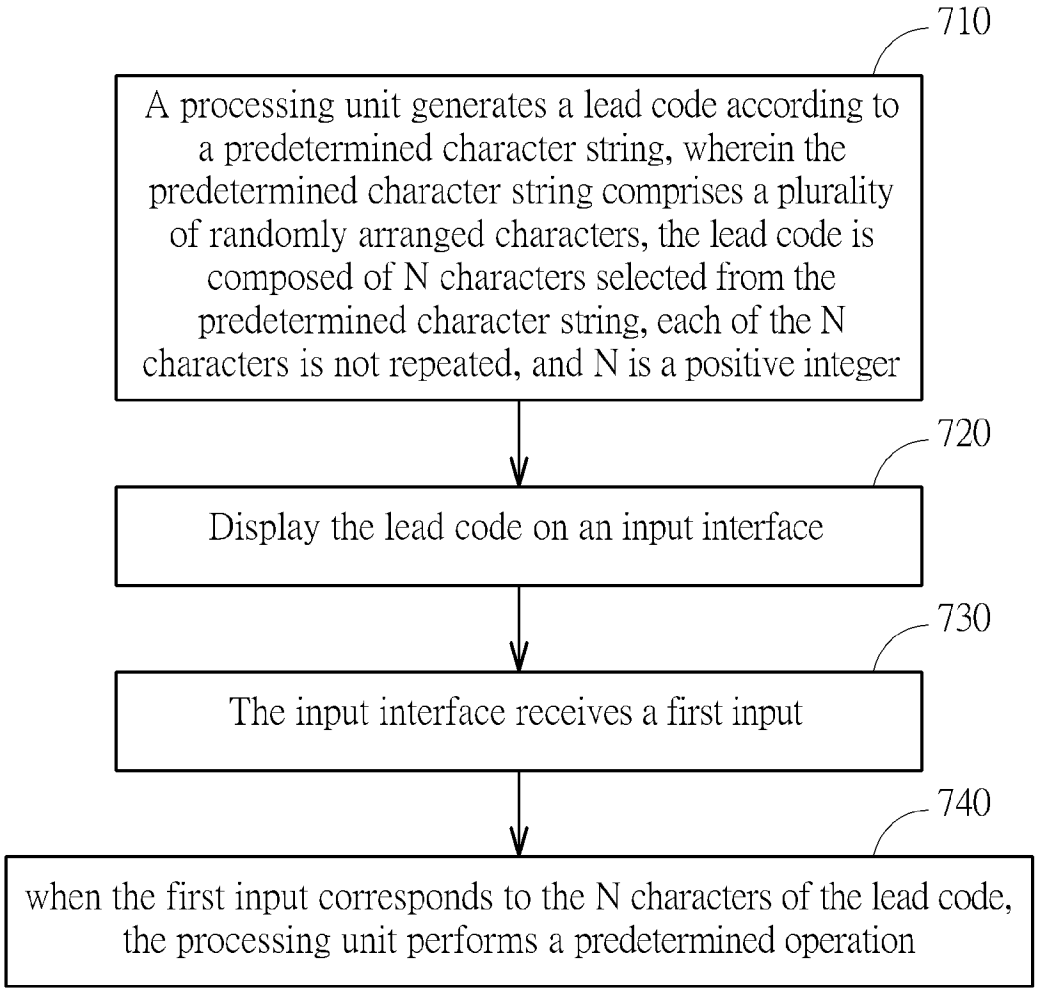
FIG. 7 is a flowchart showing an input authentication method of the present invention.

Please refer to FIG. 7. FIG. 7 is a flowchart showing the input authentication method of the present invention. As shown in FIG. 7, the flowchart of the input authentication method of the present invention comprises the following steps:

Step 710: a processing unit generates a lead code according to a predetermined character string, wherein the predetermined character string comprises a plurality of randomly arranged characters, the lead code is composed of N characters selected from the predetermined character string, each of the N characters is not repeated, and N is a positive integer;

Step 720: display the lead code on an input interface;

Step 730: the input interface receives a first input; and

Step 740: when the first input corresponds to the N characters of the lead code, the processing unit performs a predetermined operation.

In addition, in the present invention, the above steps do not have to follow the above sequence. In other words, sequence of the above steps can be changed, and other steps can also be presented between the above steps.

In contrast to the prior art, the input authentication method, the input authentication system and the lock of the present invention allow the user to enter the lead code before entering the predetermined password, and the lead code displayed by the input authentication system varies each time. Therefore, not only fingerprints left by the user after entering the lead code are distributed evenly on each button, but also button positions of the lead code entered by the user are different each time, such that it is difficult for others to break the correct predetermined password by combining numbers corresponding to the button positions pressed by the user. Therefore, the input authentication method of the present invention is capable of increasing security of the input authentication system and lock of the present invention.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. An input authentication method, comprising:

a processing unit generating a lead code according to a predetermined character string, wherein the predetermined character string comprises a plurality of randomly arranged characters, the lead code is composed of N characters selected from the predetermined character string, and N is a positive integer;

displaying the lead code on an input interface;

the input interface receiving a first input; and when the first input corresponds to the N characters of the lead code, the processing unit performing a predetermined operation.

2. The input authentication method of claim 1, wherein when the first input corresponds to the N characters of the lead code, the processing unit performs the predetermined operation comprises:

when the first input corresponds to the N characters of the lead code, the processing unit controls the input interface to receive a second input; and when the second input matches predetermined authentication information, the processing unit performs the predetermined operation.

3. The input authentication method of claim 1, wherein the predetermined character string comprises a plurality of substrings, each of the substrings comprises Arabic numbers 0 to 9, symbols and/or alphabets randomly arranged in a not-repeated manner, and arrangements of the plurality of substrings are different.

4. The input authentication method of claim 1, wherein a number of total characters in the predetermined character string is not a multiple of N.

5. The input authentication method of claim 1, wherein the predetermined character string comprises Arabic numbers 0 to 9, symbols and/or alphabets.

6. The input authentication method of claim 1, wherein the lead code is composed of N continuous characters in the predetermined character string.

7. The input authentication method of claim 1, wherein the N characters of the lead code are selected from characters mutually separated by an interval of M characters in the predetermined character string, and M is a positive integer.

8. The input authentication method of claim 1, wherein when one of the characters in the N characters is the last character of the predetermined character string, a Pth character of the predetermined character string is selected as a next character in the N characters, and P is a positive integer greater than 1.

9. An input authentication system, comprising:

a processing unit, configured to generate a lead code according to a predetermined character string, wherein the predetermined character string comprises a plurality of randomly arranged characters, the lead code is composed of N characters selected from the predetermined character string, and N is a positive integer; and an input interface, electrically connected to the processing unit, for displaying the lead code and receiving inputs;

wherein when the input interface receives a first input and the first input corresponds to the N characters of the lead code, the processing unit performs a predetermined operation.

10. The input authentication system of claim 9, wherein when the first input corresponds to the N characters of the lead code, the processing unit controls the input interface to receive a second input, and when the second input matches predetermined authentication information, the processing unit performs the predetermined operation.

11. The input authentication system of claim 9, wherein the predetermined character string comprises a plurality of substrings, each of the substrings comprises Arabic numbers 0 to 9, symbols and/or alphabets randomly arranged in a not-repeated manner, and arrangements of the plurality of substrings are different.

12. The input authentication system of claim 9, wherein a number of total characters in the predetermined character string is not a multiple of N.

13. The input authentication system of claim 9, wherein the predetermined character string comprises Arabic numbers 0 to 9, symbols and/or alphabets.

14. The input authentication system of claim 9, wherein the lead code is composed of N continuous characters in the predetermined character string.

15. The input authentication system of claim 9, wherein the N characters of the lead code are selected from characters mutually separated by an interval of M characters in the predetermined character string, and M is a positive integer.

16. The input authentication system of claim 9, wherein when one of the characters in the N characters is the last character of the predetermined character string, a Pth character of the predetermined character string is selected as a next character in the N characters, and P is a positive integer greater than 1.

17. The input authentication system of claim 9, wherein the predetermined operation is controlling an external electronic device.

18. A lock with input authentication system, comprising:

a processing unit, configured to generate a lead code according to a predetermined character string, wherein the predetermined character string comprises randomly arranged Arabic numbers 0 to 9, symbols and/or alphabets, the lead code is composed of N characters selected from the predetermined character string, and N is a positive integer;

an input interface, electrically connected to the processing unit, for displaying the lead code and receiving inputs;

a motor, electrically connected to the processing unit;

a latch; and a latch controlling unit, connected between the motor and the latch;

wherein when the input interface receives a first input and the first input corresponds to the N characters of the lead code, the processing unit controls the input interface to receive a second input; and when the second input matches a predetermined password, the processing unit controls the motor to drive the latch controlling unit to control the latch for unlocking.

19. The lock of claim 18, wherein the input interface is a touch screen comprising a plurality of virtual buttons.

20. The lock of claim 18, wherein the input interface comprises a plurality of physical buttons, and a plurality of light emitting components corresponding to the plurality of physical buttons.

* * * * *